US007832474B2

(12) United States Patent
Nguy

(10) Patent No.: US 7,832,474 B2
(45) Date of Patent: Nov. 16, 2010

(54) THERMAL ACTUATOR

(75) Inventor: Vi Nguy, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 436 days.

(21) Appl. No.: 11/690,888

(22) Filed: Mar. 26, 2007

(65) Prior Publication Data

US 2008/0236840 A1 Oct. 2, 2008

(51) Int. Cl.
*E21B 23/00* (2006.01)

(52) U.S. Cl. ..... 166/242.6; 166/377

(58) Field of Classification Search ..... 166/377, 166/383, 242.6

See application file for complete search history.

(56) References Cited

U.S. PATENT DOCUMENTS

| | | | | |
|---|---|---|---|---|
| 4,589,484 | A * | 5/1986 | Doherty et al. | 166/179 |
| 4,640,354 | A * | 2/1987 | Boisson | 166/250.01 |
| 5,209,303 | A * | 5/1993 | Barrington | 166/374 |
| 5,323,853 | A * | 6/1994 | Leismer et al. | 166/55 |
| 5,392,860 | A * | 2/1995 | Ross | 166/376 |
| 6,202,747 | B1 | 3/2001 | Lacy | |
| 6,276,457 | B1 | 8/2001 | Moffatt | |
| 6,352,119 | B1 | 3/2002 | Patel | |
| 6,425,443 | B1 | 7/2002 | Hill | |
| 6,439,305 | B1 | 8/2002 | Bakke | |
| 6,481,496 | B1 | 11/2002 | Jackson | |
| 6,523,613 | B2 | 2/2003 | Rayssiguier | |
| 6,571,879 | B1 | 6/2003 | Bebak | |
| 6,684,950 | B2 | 2/2004 | Patel | |
| 6,923,256 | B2 | 8/2005 | Parker | |
| 7,090,008 | B2 | 8/2006 | Read | |
| 7,152,674 | B2 | 12/2006 | Bowles | |
| 7,174,963 | B2 | 2/2007 | Bertelsen | |
| 2006/0278388 | A1 * | 12/2006 | Zanca et al. | 166/242.6 |

FOREIGN PATENT DOCUMENTS

| | | | |
|---|---|---|---|
| EP | 1169545 | B1 | 9/2004 |
| WO | 2000/29715 | A1 | 5/2000 |
| WO | 01/88328 | A1 | 11/2001 |
| WO | 2006/052333 | A1 | 5/2006 |

* cited by examiner

*Primary Examiner*—David J Bagnell
*Assistant Examiner*—Brad Harcourt

(57) ABSTRACT

An embodiment of a system for disconnecting a first element from a second element at a desired position in a wellbore includes a disconnect tool containing an expandable material, the disconnect tool being actuatable from a locked position, wherein the first and the second elements are interconnected, to an unlocked position, wherein the first and the second element are disconnected, upon a determined expansion of the expandable material in response to a temperature at the desired position.

11 Claims, 2 Drawing Sheets

THERMAL ACTUATOR

FIELD OF THE INVENTION

The present invention relates in general to actuators and more specifically to a thermally actuated actuator.

BACKGROUND

Oilfield tools and operations commonly utilize an actuator to shift a member to achieve a desired result such as opening or closing a valve, shifting a sleeve, energizing a seal, or disconnecting elements. In downhole wellbore operations, current technologies require some sort of surface intervention to activate the actuator. Examples of surface intervention primarily include manipulation of the well string and applying hydraulic pressure through the well string to the actuator. In at least one disconnect device, a hot fluid such as steam or a corrosive agent is utilized to melt a retaining member thereby releasing the interconnected elements.

It is a desire to provide a substantially self-contained actuator for downhole operation that does not require surface intervention for actuation. It is a still further desire to provide an actuation device that is actuated by the ambient conditions of the environment in which the actuator is positioned. It is a still further desire to provide an actuator that is actuated by expansion or contraction of a material in response to the surrounding environmental temperature.

SUMMARY OF THE INVENTION

Accordingly, thermally actuated actuators and methods are provided. In one embodiment, an actuator assembly includes a first portion, a second portion, means for releasably locking the first portion and the second portion in a locked position interconnecting the first and second portions, and an expandable material in operational connection with the locking means, the expandable material expanding in response to exposure to a selected temperature activating the locking means to an unlocked position disengaging the first portion from the second portion.

An embodiment of a system for disconnecting a first element from a second element at a desired position in a wellbore includes a disconnect tool containing an expandable material, the disconnect tool being actuatable from a locked position, wherein the first and the second elements are interconnected, to an unlocked position, wherein the first and the second element are disconnected, upon a determined expansion of the expandable material in response to a temperature at the desired position.

An embodiment of a method for disconnecting a first element from a second element at a desired location in a wellbore includes the steps of: providing a disconnect tool having first portion, a second portion, and containing an expandable material, the disconnect tool having a locked position interconnecting the first and second portions and an unlocked position disconnecting the first and second portions; making up the disconnect tool in the locked position; connecting the first element to the first portion and the second element to the second portion; positioning the disconnect tool at the desired location in the well; and activating the disconnect tool to the unlocked position upon a determined expansion of the expandable material in response to exposure of the disconnect tool to a temperature at the desired location in the wellbore.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
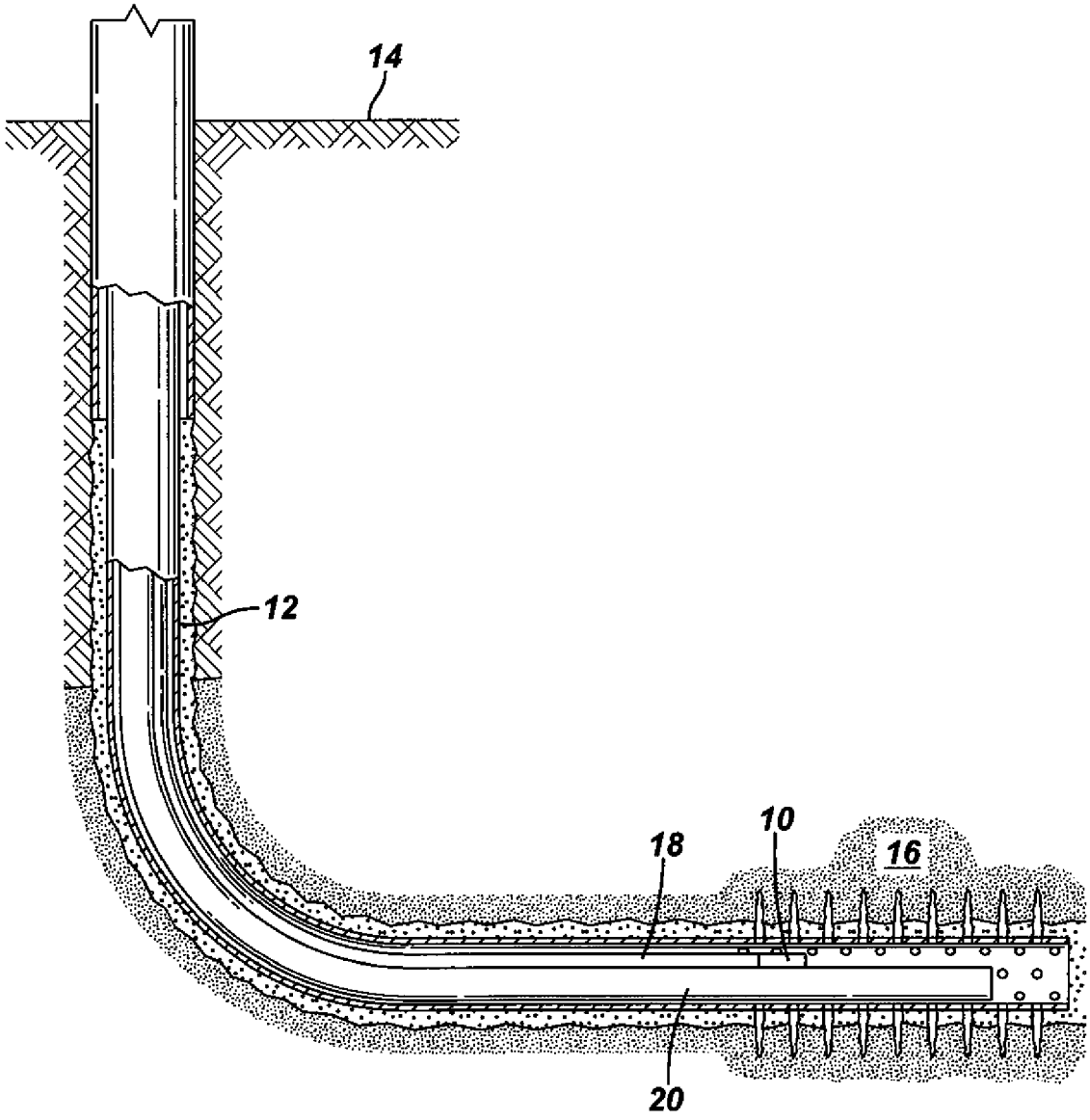
FIG. 1 is a schematic of a wellbore utilizing an embodiment of the thermal actuator of the present invention as a disconnect device.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

The present disclosure teaches an actuation device and method that may utilize the temperature of the environment in which the device is positioned for actuation. The present invention is described herein in relation to an embodiment as a disconnect device for use downhole in wellbore operations. However, it is recognized that the device and method may be utilized in various operations and processes, such as for shifting valve members, energizing seals and the like.

FIG. 1 is a schematic of a wellbore wherein an embodiment of a thermal actuator 10 is utilized as a disconnect device. Wellbore 12 is drilled from the ground surface 14 into a subterranean formation 16. Thermal actuator 10 interconnects a first element 18 and a second element 20 for running the elements in combination into wellbore 12. Upon positioning of actuator 10 and elements 18, 20 in the desired position in wellbore 12, actuator 10 is activated disconnecting elements 18 and 20.

In the illustrated embodiment, first element 18 is coiled tubing and second element 20 is a tubing string. Tubing string 20 is a primary tubing string and is utilized to run coil tubing string 18 into position without being damaged. Once coiled tubing 18 is positioned, the heat from formation 16 causes actuator 10 to actuate to a release position, disengaging coiled tubing 18 from tubing string 20. Coiled tubing 18 may then be removed from wellbore 12 leaving tubing string 20 in place for further operations, or left in position free from connection with primary tubing string 20.

Figure 2:
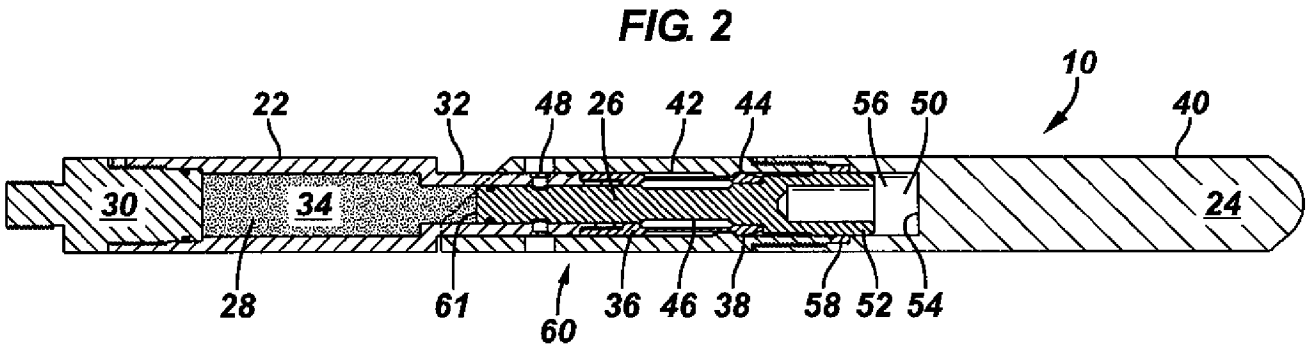
FIG. 2 is a schematic of an embodiment of the thermal actuator in a locked position.

Referring now to FIG. 2, an embodiment of thermal actuator 10 is shown in the locked position. Thermal actuator includes a first portion 22 releasably connectable with a second portion 24, a piston 26 and a thermally activated expandable material 28.

First portion 22 is cylindrical body having a connection end 30, an opposing neck 32, and an internal chamber 34. Neck 32 forms an opening into chamber 34, and is sized to receive a portion of piston 26. A collet 36, having an arm and an expanded portion or finger 38, extends substantially axially from neck 32.

Connection end 30 is illustrated as a threaded connection for connecting with coiled tubing 18 (FIG. 1). Other means of connection, such as welding or the like may be provided at connection end 30.

Second portion 24 includes a generally tubular housing forming a cavity 50 adapted to receive neck 32 and piston 26. The internal surface 42 of second portion 24 is profiled to include at least one recessed portion 44 for holding expanded region 38 of collet 36 when actuator 10 is in the first or locked position. Piston 26 includes an external, stepped platform 46 having a raised portion for maintaining expanded region 38 in recess 44 when actuator 10 is in the locked position. Piston 26 may further include an expanded diameter end 52.

When in the locked position, first portion 22 and piston 26 are held in connection with one another by mechanism 48, generally described as a shear mechanism. Shear mechanism 48 may include any shear, fracture, frangible, or rupture type device such as pins, screws, discs, or other device that releases the connection upon exertion of determined force.

Figure 3:
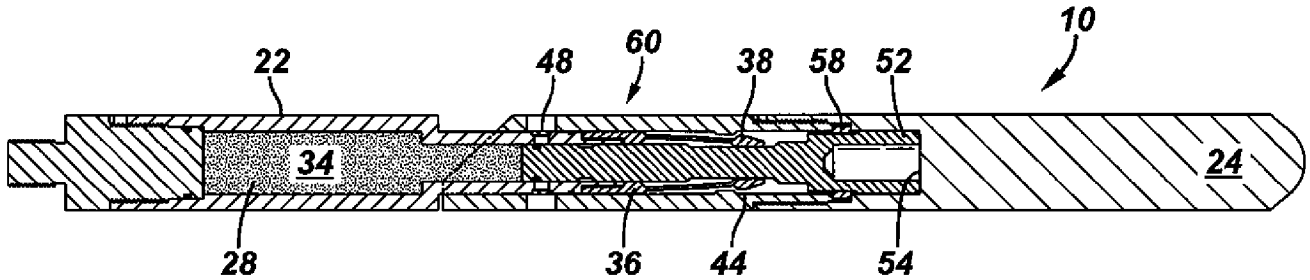
FIG. 3 is a schematic of an embodiment of the thermal actuator in the unlocked position.

Piston 36, expanded region 38, and recess 44, work in combination as a releasable locking mechanism 60. Locking mechanism 60 interconnects first and second portions in a fixed position relative to each other in the locked position to prevent the accidental or premature disconnection of first and second portions when running the tool into the wellbore. Thermally activated expandable material 28 is in operational connection with locking mechanism 60. Upon a determined expansion of material 28, locking mechanism 60 is activated to the unlocked position as shown in FIG. 3.

Second portion 24 also includes a connection end 40 adapted for connection with tubing string 20 (FIG. 1). For the illustrated and described embodiments, connection end 40 is a sub adapted for welding to the tubing string. However, it should be recognized that connection end 40 may include other engagement means, such as threading, corresponding to the desired application.

Thermally activated expandable material 28 provides the motivating or actuating energy for moving locking mechanism 60 to the unlocked position. Material 28 may include any material (fluid, solid, or gas) that expands in response to thermal energy. The volumetric thermal expansion coefficient of material 28 must be such that the material will expand in response to the temperature differential between surface 14 (FIG. 1) and at the desired depth in formation 16. Although, heat may be supplied by an operator for actuation of disconnect device 10, it is often desirable for activation to occur upon exposure to the ambient temperature at the desired location within formation 16. Examples of expandable material 28 include hydraulic oils, which are readily available for most applications, solids and gasses. Suitable hydraulic oils are provided by numerous manufactures, such as a hydraulic oil provided by Shell under the name TELLUS 32. Selection of material 28, the volume of chamber 34, and the range of movement of piston 26 may be adjusted to meet the temperature differential between the surface and the desired actuation position.

The make-up of thermal actuator 10 in the locked, or run-in, position is now described. Piston 26 is positioned with expanded end 52 disposed within cavity 50. End 52 is located a distance form the back wall 54 of cavity 50 leaving a void 56. External platform 46 of piston 26 urges and holds expanded region 38 of collet 36 within recess portion 44 of internal surface 42. A retainer mechanism 58, such as a snap spring, may be positioned from second portion 24 to engage expanded end 52 of piston 26. First element 18 is connected to first portion 22 and second element 20 is connected to second portion 24. Thermally activated expandable material 28 is disposed in chamber 34 so as to substantially fill the volume of chamber 34 to piston 26. For purposes of this example, 0.25 liters of hydraulic oil is filled in chamber 34 up to piston 26. The surface, or run-in, temperature is 20 degrees Celsius. The anticipated temperature at the desired actuation point is approximately 100 degrees Celsius, and at which point the hydraulic oil will expand to a volume of approximately 0.267 liters.

Operation of thermal actuator 10 is now described with reference to FIGS. 1 through 4. Thermal actuator 10 is made-up in the locked position interconnecting first element 18 and second element 20. Elements 18, 20 and actuator 10 are run-in to wellbore 12 to the desired depth and position.

Exposure of actuator 10, and more specifically expandable material 28 to the increased temperature in formation 16 relative to surface 14 causes material 28 to expand. Expansion of material 28 urges piston 26 axially away from first portion 22 and chamber 34. Shear mechanism 48 maintains piston 26 in a fixed position with first portion 22 maintaining a substantially constant volume of chamber 34. The pressure generated by the expansion of material 28 acts on area 61 of piston 26 exerting a force on shear mechanism 48. The pressure in chamber 34 increases until the capacity of shear mechanism 48 is exceeded, releasing the connection between first portion 22 and piston 26. The pressure from expansion of material 28 then moves piston 36 axially. As piston 26 moves, expanded region 38 of collet 36 moves radially inward against the decreasing diameter of external platform 46, releasing region 38 from engagement with recess portion 44 and second portion 24. FIG. 3 illustrates actuator 10 in the unlocked position. With locking mechanism 60 unlocked, first portion 22 is disengaged from second portion 24.

Figure 4:
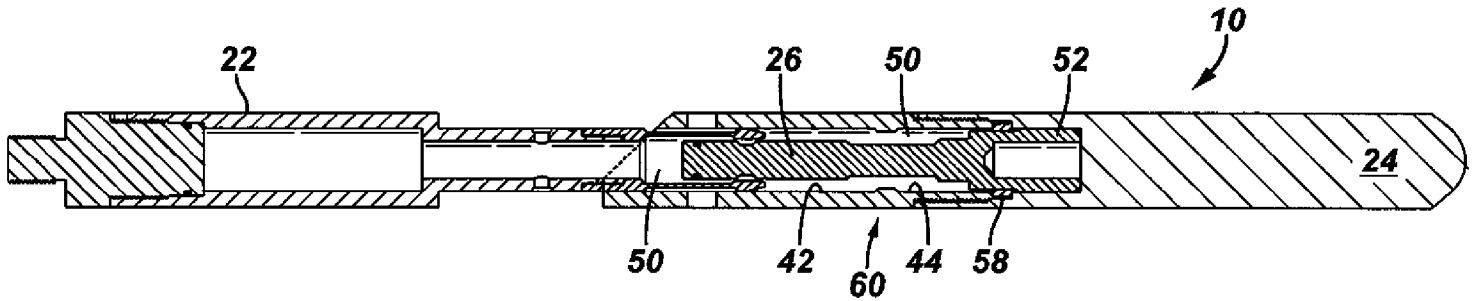
FIG. 4 is a schematic of an embodiment of the thermal actuator illustrating the disconnection of the first element from the second element.

As shown in FIG. 4, retaining mechanism 58 moves radially inward against piston 26 as end 42 moves toward and the back wall of cavity 50. This position of retaining mechanism 58 forms a restriction within cavity 50 around piston 26. The restriction maintains piston 26 in connection with second portion 24, thus preventing piston 26 from releasing into the wellbore and from re-engaging locking mechanism 60 in the locked position. FIG. 4 illustrated the separation of first portion 22 and second portion 24 upon applying an upward force to first portion 22.

From the foregoing detailed description of specific embodiments of the invention, it should be apparent that a thermal actuator that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A system for disconnecting a first element from a second element at a desired position in a wellbore, the system comprising:

a disconnect tool containing an expandable material, the disconnect tool being actuatable from a locked position, wherein the first and the second elements are interconnected, to an unlocked position, wherein the first and the second element are disconnected, upon a determined expansion of the expandable material in response to the ambient temperature at the desired position in the wellbore;

a first portion connected to the first element, the first portion having an internal chamber containing the expandable material and a neck forming an opening into the internal chamber;

a second portion connected to the second element, the second portion having a cavity receiving the neck when the tool is in the locked position; and a locking mechanism releasably holding the first portion and the second portion in the locked position.

2. The system of claim 1, wherein the locking mechanism includes a piston connected to the first portion when the tool is in the locked position.

3. The system of claim 2, further including a retaining mechanism in connection between the second portion and the piston, the retaining mechanism maintaining the piston in connection with the second portion when the tool is in the unlocked position.

4. The system of claim 1, wherein the expandable material comprises one of a fluid, a solid, or a gas.

5. A disconnect tool, comprising:

a first portion having an internal chamber containing an expandable material and a neck forming an opening into the internal chamber;

a second portion having a cavity for receiving the neck;

a member having an expanded region, the member extending axially from the neck into the cavity;

a piston disposed within the neck and the cavity, the piston urging the expanded region into engagement with the second portion when the disconnect tool is in a locked position; and a shear mechanism in connection between the first portion and the piston when the disconnect tool is in the locked position, the shear mechanism releasing the connection upon a determined expansion of the expandable material in response to the ambient temperature at the desired position in a wellbore.

6. The system of claim 5, further including a retaining mechanism in connection between the second portion and the piston, the retaining mechanism maintaining the piston in connection with the second portion when the tool is in the unlocked position.

7. The system of claim 5, wherein the expandable material comprises one of a fluid, a solid, or a gas.

8. A method for disconnecting a first element from a second element at a desired location in a wellbore, the method comprising the steps of:

providing a disconnect tool comprising a first portion having a chamber and a neck forming an opening into the chamber, a second portion having a cavity adapted to receive the neck, an expandable material disposed in the chamber and a locking mechanism releasably holding the first portion and the second portion in a locked position interconnecting the first portion and the second portion;

making up the disconnect tool in the locked position wherein the neck is received in the cavity;

connecting the first element to the first portion and the second element to the second portion;

positioning the disconnect tool at the desired location in the well; and activating the disconnect tool to an unlocked position upon a determined expansion of the expandable material in response to exposure of the disconnect tool to the ambient temperature at the desired location in the wellbore.

9. The method of claim 8, further including the step of retaining a piston in connection with the second portion upon disconnecting the first portion from the second portion.

10. The method of claim 8, wherein the expandable material comprises one of a fluid, solid, or a gas.

11. The method of claim 8, wherein the expandable material comprises an oil.

* * * * *